US005178287A

United States Patent [19]

Klein et al.

[11] Patent Number: 5,178,287

[45] Date of Patent: Jan. 12, 1993

[54] COLLAPSIBLE SUPPORT RACK

[75] Inventors: Richard B. Klein, Overland Park, Kans.; Vijay S. Malik, Kansas City, Mo.

[73] Assignee: Lynk, Inc., Shawnee Mission, Kans.

[21] Appl. No.: 639,879

[22] Filed: Jan. 11, 1991

[51] Int. Cl.[5] ..... A47G 29/00

[52] U.S. Cl. ..... 211/100; 211/104; 211/106

[58] Field of Search ..... 211/99, 100, 104, 106; 248/220.2, 220.3, 220.4, 221.1, 222.2, 222.3, 224.4, 225.2

[56] References Cited

U.S. PATENT DOCUMENTS

| | | | |
|---|---|---|---|
| 2,042,517 | 6/1936 | Ellis | 211/99 |
| 2,070,174 | 2/1937 | Pace | 211/99 |
| 2,217,795 | 10/1940 | Dawson | 211/100 |
| 2,618,391 | 11/1952 | Hastings | 211/99 |
| 2,666,530 | 1/1954 | Beren | 211/99 |
| 3,194,406 | 7/1965 | Simeti | 211/100 |
| 4,611,721 | 9/1986 | Heckaman | 211/99 |

*Primary Examiner*—David L. Talbott
*Attorney, Agent, or Firm*—Kokjer, Kircher, Bowman

[57] ABSTRACT

A collapsible support rack having a mounting member adapted to be placed on a vertical wall and a support member, attached to the mounting member, adapted to support the objects intended to be stored. The support member includes a plurality of rods spaced outwardly from the mounting member. The support member is movable between a lowered position in which the support member hangs downwardly from the mounting member such that the rods are substantially horizontally extending and vertically spaced, and a raised position in which the support member extends outwardly from the vertical wall such that the rods are horizontally extended but at least somewhat horizontally spaced. Hook means are provided on a first end of the support member for hanging the support member in the lowered position and for releasably locking the support member in the raised position.

17 Claims, 1 Drawing Sheet

COLLAPSIBLE SUPPORT RACK

BACKGROUND OF THE INVENTION

1. Field of the Invention

The present invention relates in general to an apparatus for supporting items in storage. In particular, the present invention relates to a collapsible device for storing items, particularly apparel and clothing accessories.

2. Description of the Related Art

Various devices have been known for storing apparel accessories such as ties, belts, scarves and necklaces. With regard to ties, a common device is a mounting plate having a row of cantilevered rods extending outwardly therefrom. One or more ties are then draped over each of these cantilevered rods. While this arrangement requires little space for the storage of the ties, it is difficult to see or remove the ties which have been draped over the rods. The provision of tie hangers interposed between the tie and the rod eliminates this problem to a certain extent, however those ties which are not outermost are still difficult to see.

A similar arrangement has been available for necklaces in the form of jewelry trees having numerous different designs. In general, these trees include a plurality of hooks or cantilevered rods upon which the necklaces or jewelry are draped. Such jewelry trees suffer the visibility problems noted above, and it is often difficult to remove a particular necklace from such a tree.

Scarves are often hung one upon the other on a hook extending outwardly from the wall. Another common method of storing scarves is to place folded scarves within a drawer. With each of these methods it is apparent that it is difficult to view the scarves which are not uppermost. In addition, storing folded scarves within a drawer often causes wrinkling of the scarves.

SUMMARY OF THE INVENTION

An object of the present invention is to provide a support rack which requires minimal storage space.

Another object of the present invention is to provide a support rack which allows all of the stored items to be easily viewed.

A further object of the present invention is to provide a support rack which allows the items supported thereon to be easily removed.

These and other objects are achieved by a collapsible support rack having a mounting member adapted to be placed on a vertical wall and a support member, attached to the mounting member, adapted to support the objects intended to be stored.

The support member includes a plurality of rods spaced outwardly from the mounting member. The support member is movable between a lowered position in which the support member hangs downwardly from the mounting member such that the rods are substantially horizontally extending and vertically spaced, and a raised position in which the support member extends outwardly from the vertical wall such that the rods are horizontally extending but at least somewhat horizontally spaced. Means are also provided for releasably locking the support member in the raised position.

BRIEF DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
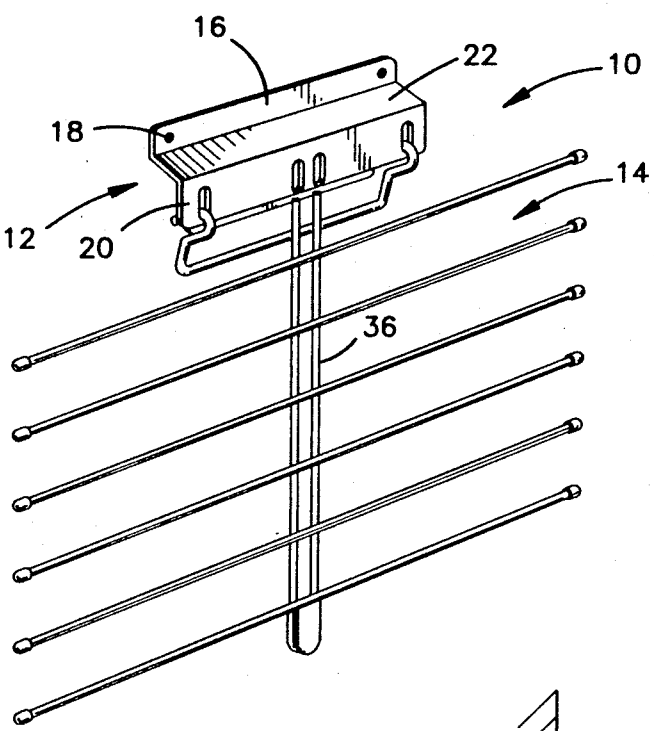
FIG. 1 is a perspective view of the support rack of the present invention in the lowered position.

With reference to FIG. 1, the device according to the present invention is generally referenced by numeral 10. The device 10 comprises a mounting member 12 and a support member 14.

The mounting member 12 is adapted to be mounted upon a surface, such as a vertical wall or door, such that the device 10 may be easily viewed and used.

The mounting member 12 includes a substantially planar rear plate 16 which is adapted to abut the vertical wall. Although indicated as planar, rear plate 16 could of course take other configurations to conform to the surface upon which the device 10 is to be mounted. Rear plate 16 may also include appropriate through holes 18 to allow the rear plate to be fixed to the vertical wall by screws, although the rear plate could be fixed by other means, such as magnets or adhesives.

Mounting member 12 also includes a front plate 20. The front plate 20 is spaced from the rear plate 16 by a transition member 22, such that the front plate 20 will be spaced from the vertical wall when the mounting member 12 is attached thereto. Front plate 20 therefore defines an outer face 24 and an inner face 26. Front plate 20 also includes a pair of horizontally spaced mounting slots 28 which extend through the front plate 20.

The mounting member 12 may advantageously be formed of a single piece of metal which is appropriately stamped and bent to form the mounting member. The mounting member 12 could also be formed of ceramics or plastics or other materials, including composites. To ensure that the mounting member 12 is sufficiently rigid and maintains the front plate 20 spaced from the vertical wall, the mounting member 12 may be reinforced by a spacer member 30 extending rearwardly from the lower edge of the front plate 20 back to the vertical wall.

An auxiliary rear plate 32 may extend downwardly from the inner end of the spacer member 30 such that the auxiliary rear plate will abut against the vertical wall in a manner similar to rear plate 16. Appropriate through holes 34, similar to tyrough holes 18, may extend through the auxiliary rear plate 32 to allow screws to be passed through the auxiliary rear plate and into the vertical wall.

For reasons made clear below, it is preferred that the spacer member 30 be spaced horizontally inwardly from the horizontally spaced mounting slots 28. Alternatively, the spacer member 30 could have appropriate openings adjacent the mounting slots 28.

The support member 14 includes an elongated central strut 36. The elongated central strut 36 defines a longitudinal axis along which a plurality of rods 38 are spaced. The rods 38 extend substantially perpendicular to the longitudinal axis of central strut 36 and extend substantially horizontally and parallel to the plane of the vertical wall. As each of the rods 38 is mounted to the central strut 36 at substantially the midpoint of the rod, the ends of each of the rods are free. This will allow the items to be stored to be easily placed upon, and removed from, the rods 38, as is discussed more fully below.

To improve aesthetic appearance and reduce the possibility of damaging the items to be stored, the free ends of the rods 38 may include tips 40 formed of an appropriate rubber or plastic. The portion of central strut 36 which extends beyond the spaced rods 38 may also be covered by a strut tip 42 of an appropriate rubber or plastic material.

A first end 44 of central strut 36 is connected to a crossbar 46. The crossbar 46 extends substantially perpendicular to the longitudinal axis to the central strut 36 and is substantially parallel to the rods 38. The outer ends of the crossbar 46 each include a hook means 48 for attachment of the support member 14 to the mounting member 12.

Figure 3:
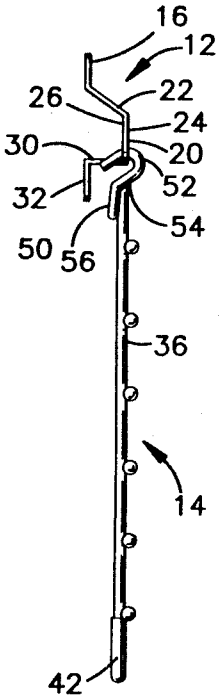
FIG. 3 is a side view of the support rack of FIG. 2.
Figure 2:
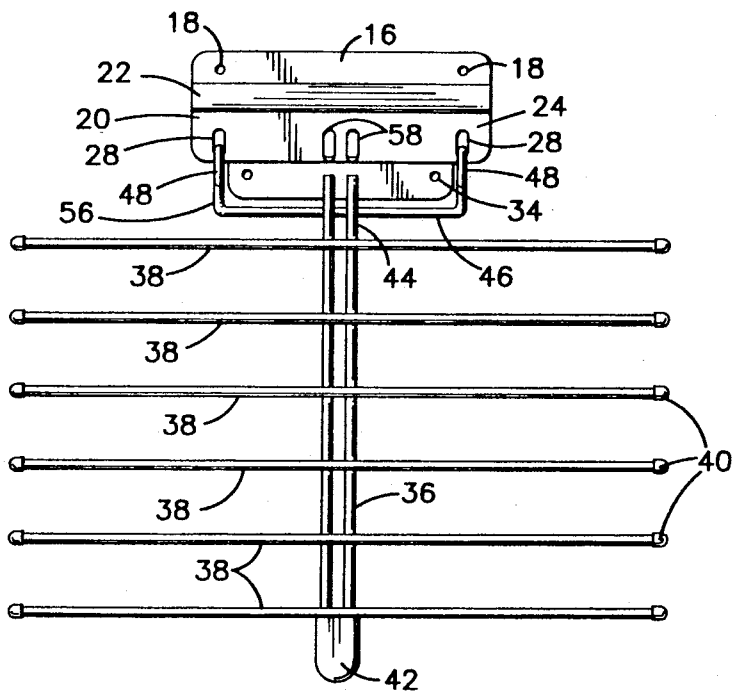
FIG. 2 is a front view of the support rack of the present invention in the lowered position.

Each of the hook means 48 is generally in the form of a hook having a free end 50 which may be inserted through the mounting slots 28 from the outer face 24 of the front plate 20. As shown in FIGS. 1-3, when the free end 50 of the hook means 48 has been inserted through the mounting slots 28, the support member 14 will hang downwardly from the mounting member 12. This arrangement defines the support position of the support member 14. In this position, the articles supported upon the rods 38 for storage may be easily viewed.

As is best shown in FIGS. 1 and 3, the free ends 50 of the hook means may have a length such that they extend below the lower edge of the front plate 20. Spacing the lateral ends of the spacer member 30 inwardly of the mounting slots, as discussed above, will thus eliminate fouling of the free ends 50 on the spacer member 30. Lengthening the front plate 20 in the vertical direction, such that mounting slots 28 are spaced further from the spacer member 30, would of course eliminate the need to reduce the width of the spacer member 30.

As noted above, the hook means 48 include free ends 50. In addition, each of the hook means 48 include a curved portion 52 inwardly of the free end 50. This curved portion 52 leads into an abutment section 54 which is connected to the crossbar 46. This abutment section 54 allows the support member 14 to be placed in the raised position.

Figure 4:
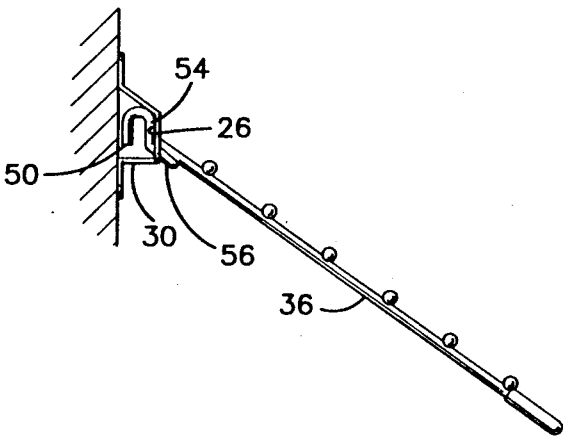
FIG. 4 is a side view of the support rack in the raised position.

The raised position of the support member 14 is shown in FIG. 4. In this position, the entirety of the hook means 48 have been inserted through the mounting slots 28. The central strut 36 extends outwardly from the vertical wall in this position, and is held in this outwardly extending position by abutment segment 54 abutting against the inner face 26, above the mounting slots 28, of the front plate 20. Additional support is also to be provided by the abutment segment 54 abutting against the lower edge of the mounting slots 28. In this manner, the support member 14 is releasably held in the raised position.

To ensure that the lower edge of the hook means 48 abuts against the lower edge of the mounting slots 28, a hook extension 56 may be formed between the crossbar 46 and the curved portion 52 of the hook means, with this hook extension 56 abutting against the lower edge of the mounting slot 28.

As may be readily envisioned, when the device 10 is in the raised position shown in FIG. 4, the articles intended to be stored thereon, such as ties, scarves, belts, towels or necklaces, may be individually draped over associated ones of the rods 38. As is shown in FIG. 4, the rods 38 are at least horizontally spaced, and are preferably both horizontally and vertically spaced, when the support member 14 is in the raised position. This horizontal spacing of the rods 38 allows sufficient room such that an article stored upon one of the rods 38 may be removed from, or placed on, this rod 38 without disturbing the articles hung upon adjacent ones of the rods 38. As such, the raised position of the support member 14 is employed when access to the articles hung upon the rods 38 is desired.

Once the desired access to the articles hung upon the rods 38 has been completed, the support member 14 is moved to the storage or lowered position, shown in FIGS. 1-3. To effect this, the central strut 36 is simply raised slightly by hand such that the hook means 48 (or hook extension 56) disengages from the lower edge of the mounting slot 28. Due to the weight of the support member 14, the hook means 48 will slide downwardly such that the curved portion 52 of the hook means 48 engages the lower edge of the mounting slots 28. At this point, the outer end of the central strut 36 is lowered until the support member hangs freely by the hook means 48 retained within the mounting slots 28.

In this lowered position, it may be readily envisioned that the articles hung upon the rods 38 will be partly visible. It is also noted that, as shown in FIG. 3, the device 10 has a small profile when the support member 14 is in the lowered position. As such, the device 10 with articles hung thereon will use a minimum of storage space.

It is of course evident to those of ordinary skill in the art that various modifications could be made to the present invention. For example, the first end 44 of the central strut 36 could be extended beyond the crossbar 46. In such a situation it may be necessary to provide appropriate through holes 58 in front plate 20 to ensure that the extension of the central strut 36 does not prohibit the entry of the hook means 48 into the mounting slots 28 when the support member 14 is placed in the raised position.

Additionally, the support member 114 may be formed of a wide variety of materials. Metal rods bent to the appropriate shape and welded together is a preferred method of forming the support member 14, although plastics and other materials may be employed. Additionally, the number, size and cross sectional configuration of the rods 38 could, of course, be varied. Finally, although the rods 38 have been shown as extending substantially straight, the rods could be bent at their outer ends to help prevent the articles from slipping off of the rods 38, or could include other bends and configurations suitable for particular objects or articles intended to be hung thereon.

From the foregoing it will be seen that this invention is one well adapted to attain all ends and objects hereinabove set forth together with the other advantages which are obvious and which are inherent in the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

What is claimed is:

1. A collapsible storage rack, comprising:

a mounting member adapted to be fixed to a surface, said mounting member including a front plate spaced from the surface, said front plate having an inner face facing the surface and at least two spaced mounting slots extending through said front plate; and a support member having means for supporting articles thereon, said support member having a first end with a cross bar mounted thereon, said cross bar having two free ends extending outwardly from said support member, hook means mounted on each of said free ends of said cross bar, each said hook means having an abutment segment, a curved portion and a free end, whereby said free end may be inserted through said mounting slot such that said curved portion is engaged in said slot and said support member is coupled to said mounting member in a lowered position, and said hook means may be inserted through said slot such that said abutment segment engages said inner face and a lower edge of said mounting slot and said support member extends outwardly from said front plate and is coupled to said mounting member in a raised position.

2. A support rack as in claim 1, wherein said support member further includes a central strut having a longitudinal axis, and wherein said means for supporting articles comprises a plurality of rods, said rods being mounted to said central strut at spaced positions along said longitudinal axis.

3. A support rack as in claim 2, wherein said rods are mounted to said central strut at substantially the center point of said rods, and extend outwardly from said central strut substantially perpendicular to said longitudinal axis.

4. A support rack as in claim 3, wherein each of said rods lies substantially within a common plane.

5. A support rack as in claim 4, wherein the surface is a substantially vertical plane, and wherein said central strut hangs downwardly due to the force of gravity when said support member is in said lowered position.

6. A support rack as in claim 5, wherein said common plane in which said rods lie is substantially parallel to the surface when said support member is in said lowered position and is oblique to the surface when said support member is in said raised position.

7. A support rack as in claim 1, wherein said mounting member includes a rear plate adapted to be fixed to the surface and a transition plate extending between said rear plate and said front plate.

8. A support rack as in claim 7, wherein said support member further includes a central strut having a longitudinal axis, and wherein said means for supporting articles comprises a plurality of rods, said rods being mounted to said central strut at spaced positions along said longitudinal axis.

9. A support rack as in claim 8, wherein said rods are mounted to said central strut at substantially the center point of said rods, and extend outwardly from said central strut substantially perpendicular to said longitudinal axis.

10. A support rack as in claim 9, wherein each of said rods lies substantially within a common plane.

11. A support rack as in claim 10, wherein the surface is a substantially vertical plane, and wherein said central strut hangs downwardly due to the force of gravity when said support member is in said lowered position.

12. A support rack as in claim 11, wherein said common plane in which said rods lie is substantially parallel to the surface when said support member is in said lowered position and is oblique to the surface when said support member is in said raised position.

13. A support rack as in claim 1, wherein each of said hook means further includes a hook extension between said curved portion and said cross bar, and wherein said hook extension abuts against said lower edge of said mounting slot when said support member is in said raised position.

14. A support rack as in claim 13, wherein said mounting member includes a rear plate adapted to be fixed to the surface and a transition plate extending between said rear plate and said front plate.

15. A support rack as in claim 14, wherein said support member further includes a central strut having a longitudinal axis, and wherein said means for supporting articles comprises a plurality of rods, said rods being mounted to said central strut at spaced positions along said longitudinal axis.

16. A support rack as in claim 15, wherein said rods are mounted to said central strut at substantially the center point of said rods, and extend outwardly from said central strut substantially perpendicular to said longitudinal axis.

17. A support rack as in claim 16, wherein each of said rods lies substantially within a common plane.

* * * * *